US006250572B1

(12) United States Patent
Chen

(10) Patent No.: US 6,250,572 B1
(45) Date of Patent: Jun. 26, 2001

(54) SHOWERHEAD

(75) Inventor: Jackson Chen, Taichung (TW)

(73) Assignee: Globe Union Industrial Corp. (TW)

( * ) Notice: Subject to any disclaimer, the term of this patent is extended or adjusted under 35 U.S.C. 154(b) by 0 days.

(21) Appl. No.: 09/656,897

(22) Filed: Sep. 7, 2000

(51) Int. Cl.[7] ..... B05B 1/00; B05B 1/30

(52) U.S. Cl. ..... 239/602; 239/533.13; 239/533.14

(58) Field of Search ..... 239/602, 550, 239/556, 558, 559, 567, 546, 533.13, DIG. 12; 4/675, 678, 596, 605, 615, 903

(56) References Cited

U.S. PATENT DOCUMENTS

| | | | | |
|---|---|---|---|---|
| 4,241,878 | * | 12/1980 | Underwood | 239/591 |
| 5,172,862 | * | 12/1992 | Heimann et al. | 239/602 |
| 5,228,625 | * | 7/1993 | Grassberger | 239/602 |
| 5,405,089 | * | 4/1995 | Heimann et al. | 239/533.13 |
| 5,702,057 | * | 12/1997 | Huber | 239/602 |
| 5,730,361 | * | 3/1998 | Thonnes | 239/602 |
| 5,850,974 | * | 12/1998 | Kettl et al. | 239/602 |

FOREIGN PATENT DOCUMENTS

| | | | | |
|---|---|---|---|---|
| 599 989 | * | 7/1934 | (DE) | 239/602 |
| 1 055 869 | * | 4/1959 | (DE) | 239/602 |
| 1.309.901 | * | 10/1961 | (FR) | 239/533.13 |

* cited by examiner

*Primary Examiner*—David A. Scherbel
*Assistant Examiner*—Davis Hwu
(74) *Attorney, Agent, or Firm*—Akin, Gump, Strauss, Hauer & Feld, L.L.P.

(57) ABSTRACT

A showerhead includes a housing and a face plate to confine a chamber therebetween. A plurality of spray nipples are mounted on the face plate. Each spray nipple includes a nozzle body and a securing sleeve member. The nozzle body is made of a deformable material, and includes a stem portion with a shank end fitted to a respective inner peripheral wall in the face plate, a tapered end extending outwardly of a front major wall of the face plate, and a shoulder portion formed at a juncture of the shank and tapered ends. An enlarged head portion is secured to the shank end opposite to the tapered end, and defines an abutment shoulder to abut against a rear major wall of the face plate. A spray passageway extends from the stem portion through the enlarged head portion. Thus, the tapered end is bendable relative to the front major wall such that particulate dirt will be bounced out of the spray passageway once the tapered end swings back to its original state. The securing sleeve member is sleeved on the shank end, and abuts against the shoulder portion and the front major wall to cooperate with the abutment shoulder to clamp the face plate therebetween so as to secure the respective spray nipple to the face plate.

4 Claims, 5 Drawing Sheets

SHOWERHEAD

BACKGROUND OF THE INVENTION

1. Field of the Invention

This invention relates to a showerhead, more particularly to a showerhead with a plurality of bendable spray nipple bodies such that particulate dirt therein can be bounced out.

2. Description of the Related Art

Referring to FIG. 1, a conventional showerhead 1 is shown to include a housing 1 with a screw hole 102 formed therein, and a face plate 2 with a surrounding wall 201 to cover the housing 1 so as to confine a water chamber 101. The face plate 2 has a hole 202 such that a threaded stem 502 of a screw fastener 5 passes through the hole 202 and engages threadedly the screw hole 102 to secure the face plate 2 on the housing 1. A sealing ring 3 is clamped between the housing 1 and the face plate 2. The face plate 2 further has a plurality of spray nipple members 4 secured on a front wall 203 thereof. Each spray nipple member 4 has a spray hole 401 formed therethrough so as to permit water in the chamber 101 to be discharged through the spray hole 401. When the spray holes 401 are to be cleaned to remove particulate dirt therein after long term use, the screw fastener 5 must be removed from the face plate 2 by a tool 6 which is used to turnahead 501 of the screw fastener 5. Then, the spray holes 401 are cleaned one by one. Therefore, the cleaning operation is inconvenient to conduct.

SUMMARY OF THE INVENTION

The object of the present invention is to provide a showerhead which has a plurality of bendable spray nipple bodies to facilitate cleaning of spray passageways thereof.

According to this invention, the showerhead includes a housing with a main inlet adapted to communicate with a water source, and a face plate which tightly covers the housing to confine with the housing a chamber that communicates with the main inlet. The face plate has a front major wall, a rear major wall opposite to the front major wall in a spray direction, and a plurality of inner peripheral walls, each of which extends from the front major wall through the rear major wall to confine a through hole so as to permit water in the chamber to be discharged therethrough in the spray direction. A plurality of spray nipples are mounted on the face plate. Each spray nipple includes a nozzle body and a securing sleeve member. The nozzle body is made of a deformable material, and includes a stem portion and an enlarged head portion. The stem portion includes a shank end which is fitted to the respective inner peripheral wall of the face plate from the rear major wall through the front major wall, a tapered end which extends from the shank end in a first direction away from the rear major wall and outwardly of the front major wall and which converges in the first direction, and a shoulder portion which is formed at a juncture of the shank and tapered ends and which extends outwardly and radially from the shank end. The enlarged head portion is connected securely to the shank end opposite to the tapered end, and defines with the shank end an abutment shoulder which abuts against the rear major wall when the shank end of the stem portion is fitted to the respective inner peripheral wall. A spray passageway extends from the stem portion through the enlarged head portion in the first direction to communicate with the chamber for discharging water in the chamber outwardly of the tapered end. Thus, the tapered ends of the spray nipples are bendable relative to the front major wall such that particulate dirt will be bounced out of the spray passageways once the tapered ends swing back to their original state. The securing sleeve member is sleeved on the shank end of the stem portion, and has front and rear abutting end portions which abut against the shoulder portion and the front major wall respectively after the securing sleeve member has been brought to sleeve over the tapered end, to cooperate with the abutment shoulder to clamp the face plate therebetween so as to secure the respective spray nipple to the face plate.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
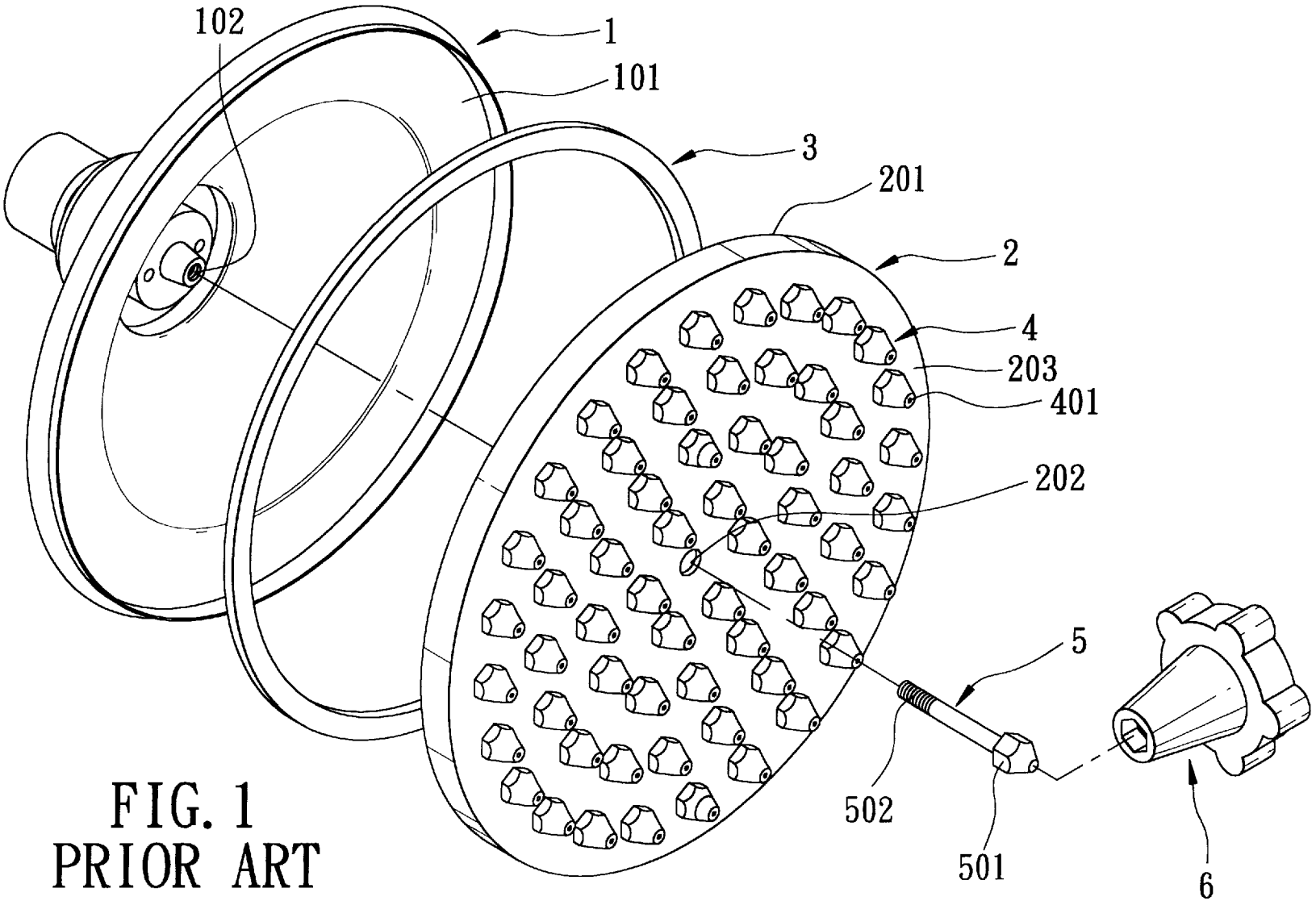
FIG. 1 PRIOR ART
FIG. 1 is an exploded perspective view of a conventional showerhead.
Figure 2:
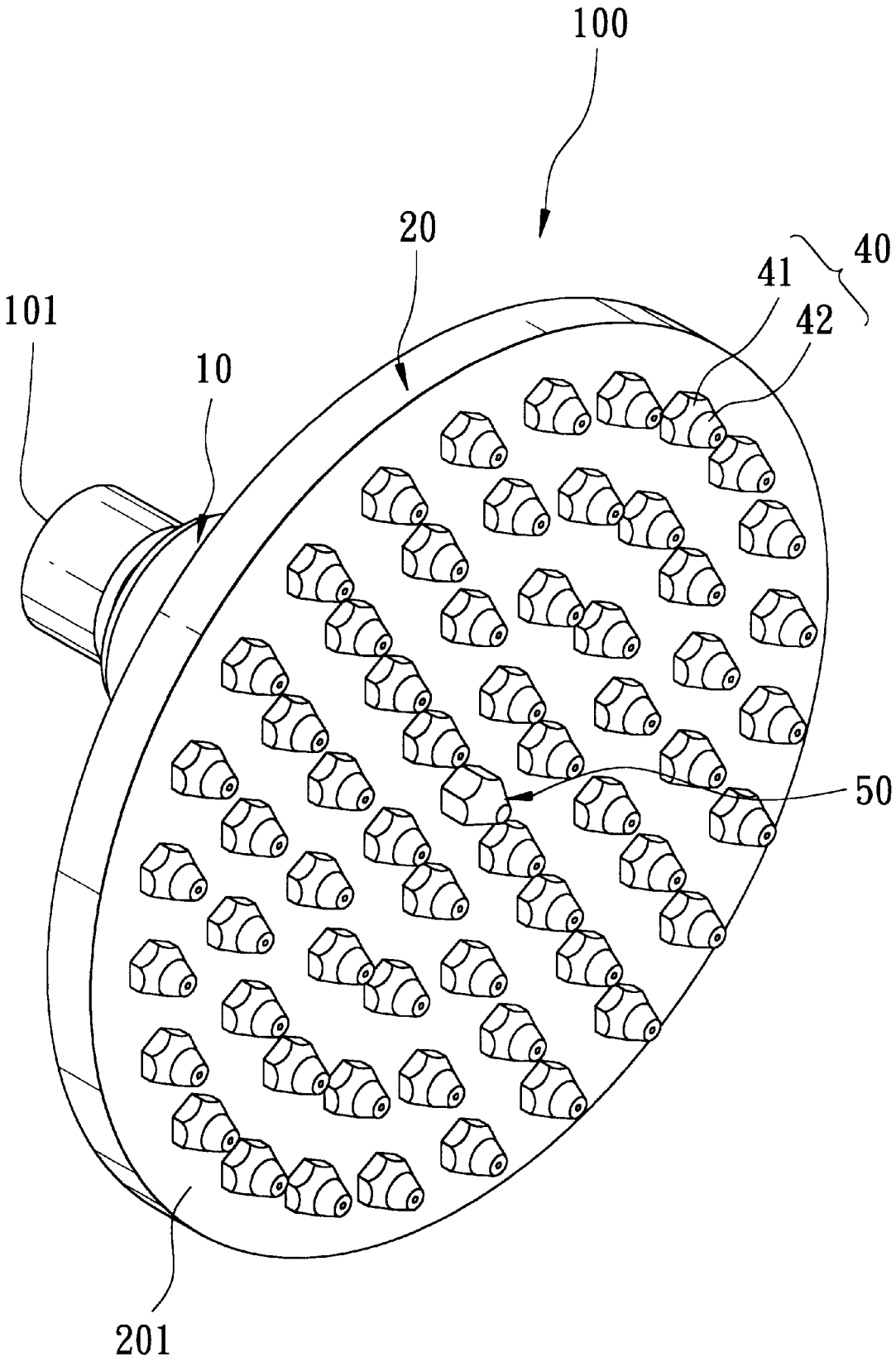
FIG. 2 is a perspective view of a preferred embodiment of a showerhead according to this invention.
Figure 3:
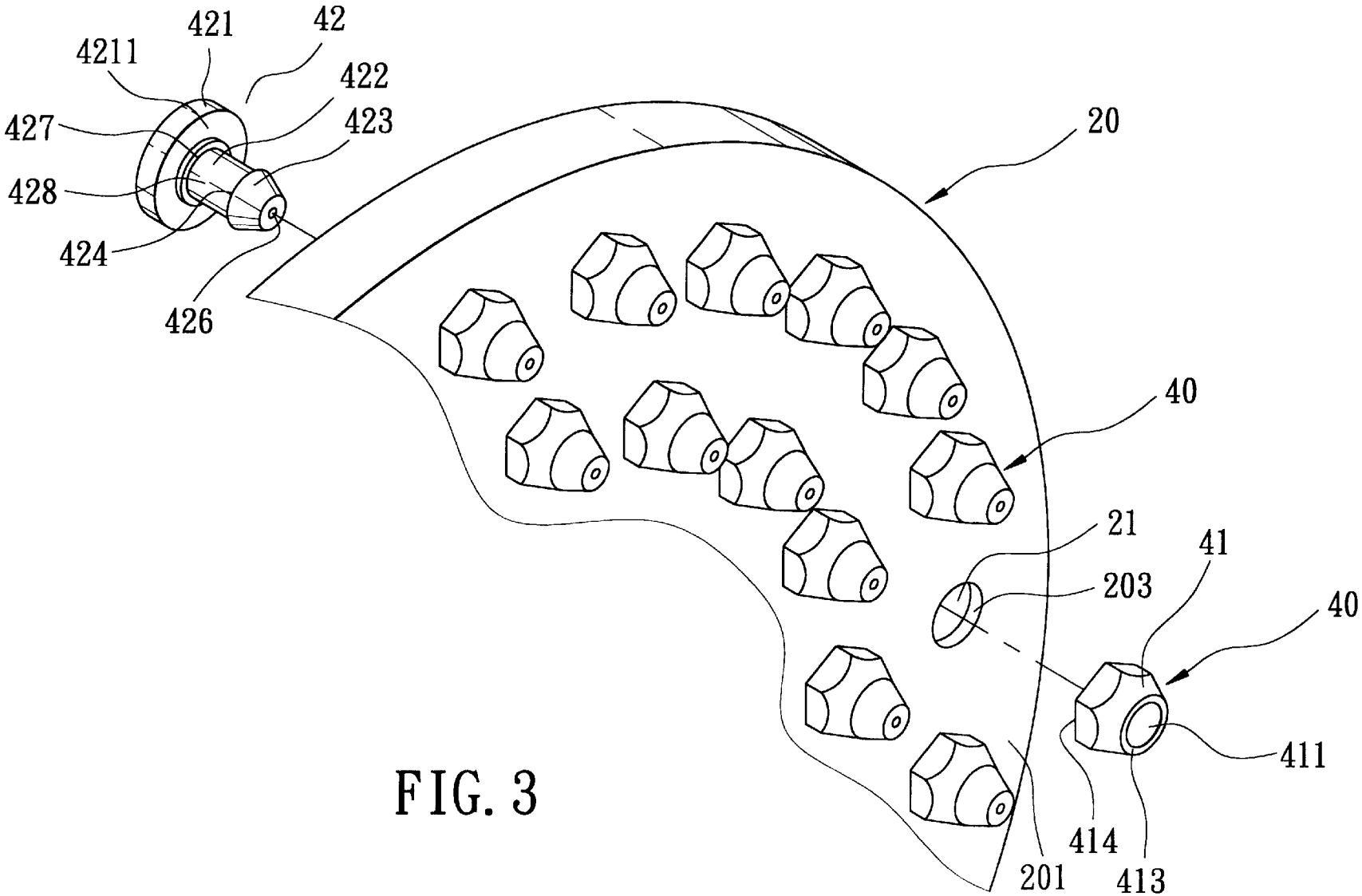
FIG. 3 is an exploded perspective view of a portion of the preferred embodiment.
Figure 4:
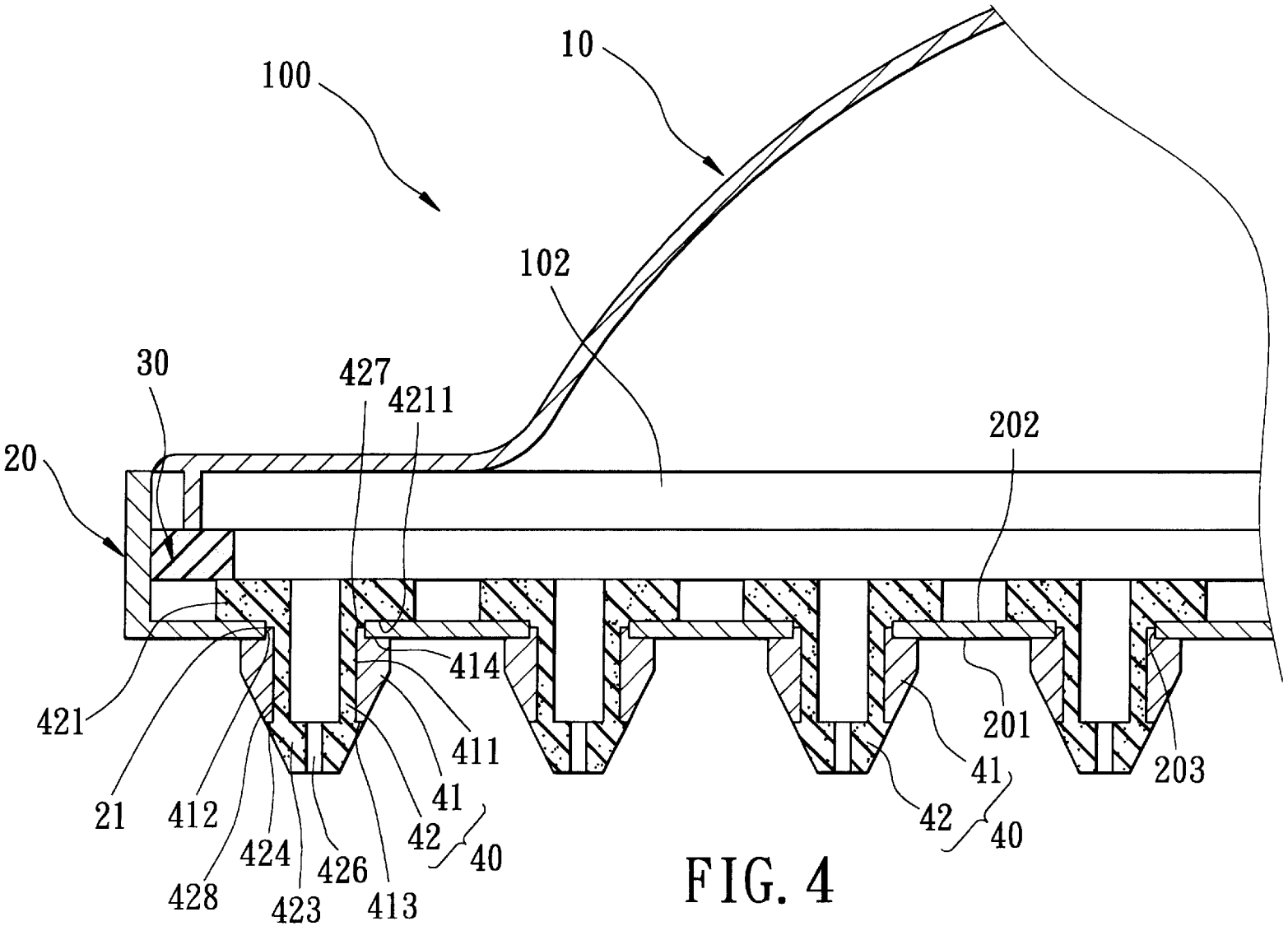
FIG. 4 is a sectional view of a portion of the preferred embodiment.

Referring to FIGS. 2, 3 and 4, the preferred embodiment of the showerhead 100 according to the present invention is shown to comprise a housing 10 with a main inlet 101 which is adapted to communicate with a water source. A face plate 20 is disposed to cover tightly and sealingly the housing 10 through the use of a screw fastener 50 and a sealing ring 30 to confine with the housing 10 a chamber 102 which communicates with the main inlet 101. The face plate 20 has a front major wall 201, a rear major wall 202 opposite to the front major wall 201 in a spray direction, and a plurality of inner peripheral walls 203. Each inner peripheral wall 203 extends from the front major wall 201 through the rear major wall 202 to confine a through hole 21 so as to permit water in the chamber 102 to be discharged therethrough in the spray direction.

A plurality of spray nipples 40 are mounted securely to the through holes 21, respectively. Each spray nipples 40 includes a nozzle body 42 which is made of rubber, and a securing sleeve member 41 which is made of metal.

The nozzle body 42 includes a stem portion 422 and an enlarged head portion 421. The stem portion 422 includes a shank end 428 which is fitted to a respective one of the inner peripheral walls 203 of the face plate 20 from the rear major wall 202 through the front major wall 201, a tapered end 423 which extends from the shank end 428 in a first direction away from the rear major wall 202 and outwardly of the front major wall 201 and which converges in the first direction, and a shoulder portion 424 which is formed at a juncture of the shank and tapered ends 428, 423 and which extends outwardly and radially from the shank end 428. The enlarged head portion 421 is connected securely to the shank end 428 opposite to the tapered end 423, and defines with the shank end 428 an abutment shoulder 4211 which abuts against the rear major wall 202 when the shank end 428 of the stem portion 422 is fitted to the respective inner peripheral wall 203. A spray passageway 426 extends from the stem portion 422 through the enlarged head portion 421 in the first direction to communicate with the chamber 102 for discharging water in the chamber 102 outwardly of the tapered end 423. In this embodiment, the nozzle body 42 further includes an engaging flange 427 which is formed on the abutment shoulder 4211 and which is inserted in the respective through hole 21 and in friction contact with the respective inner peripheral wall 203 of the face plate 20.

The securing sleeve member 41 has a sleeve hole 411 to be sleeved on the shank end 428 of the stem portion 422 of the nozzle body 42, and includes front and rear abutting end portions 413, 414 which abut against the shoulder portion 424 of the shank end 428 of the nozzle body 42 and the front major wall 201 of the face plate 20 respectively after the securing sleeve member 41 has been brought to sleeve over the tapered end 423 on the shank end 428. Thus, the securing sleeve member 41 cooperates with the abutment shoulder 4211 to clamp the face plate 20 therebetween so as to secure the spray nipple 40 to the face plate 20. The securing sleeve member 41 further includes an engaging ring 412 which is formed on and which extends rearwardly of the rear abutting end portion 414 so as to abut against the engaging flange 427 of the nozzle body 42 in the respective through hole 21 after the securing sleeve member 41 has been sleeved on the shank end 428.

Figure 5:
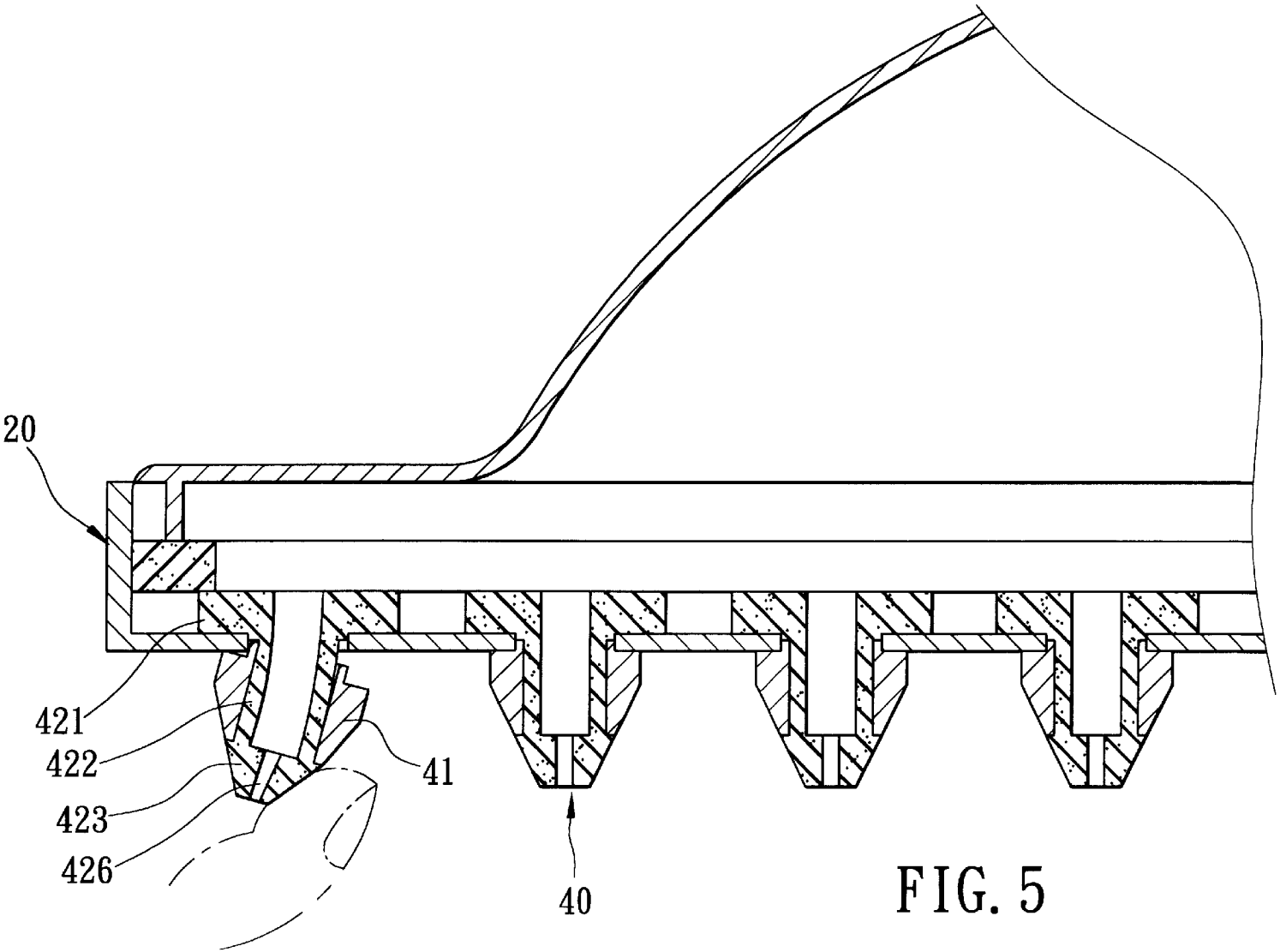
FIG. 5 is a sectional view showing how a spray nipple body bends relative to a front major wall of a face plate.

As such, with reference to FIG. 5, the tapered end 423 is disposed to be bendable relative to the front major wall 201 such that particulate dirt will be bounced out of the spray passageway 426 once the bent tapered end 423 swings back to its original state. At the same time, water can be supplied to spray out via the spray passageways 426 to facilitate removal of the particulate dirt therein. Therefore, it is not required to separate the face plate 20 from the housing 10, thereby resulting in convenience when cleaning the spray passageways 426 of the spray nipples 40.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A showerhead comprising:

a housing with a main inlet adapted to communicate with a water source;

a face plate tightly covering said housing to confine with said housing a chamber communicating with said main inlet, said face plate having a front major wall, a rear major wall opposite to said front major wall in a spray direction, and a plurality of inner peripheral walls each extending from said front major wall through said rear major wall to confine a through hole so as to permit water in said chamber to be discharged therethrough in the spray direction; and a plurality of spray nipples, each including a nozzle body made of a deformable material, and including a stem portion including a shank end which is fitted to a respective one of said inner peripheral walls from said rear major wall through said front major wall, a tapered end which extends from said shank end in a first direction away from said rear major wall and outwardly of said front major wall and which converges in the first direction, and a shoulder portion which is formed at a juncture of said shank and tapered ends and which extends outwardly and radially from said shank end, an enlarged head portion connected securely to said shank end opposite to said tapered end, and defining with said shank end an abutment shoulder which abuts against said rear major wall when said shank end of said stem portion is fitted to said respective one of said inner peripheral walls, and a spray passageway extending from said stem portion through said enlarged head portion in the first direction to communicate with said chamber for discharging water in said chamber outwardly of said tapered end, said tapered end being disposed to be bendable relative to said front major wall such that particulate dirt will be bounced out of said spray passageway once said tapered end swings back to its original state, and a securing sleeve member sleeved on said shank end of said stem portion, and having front and rear abutting end portions which abut against said shoulder portion and said front major wall respectively after said securing sleeve member has been brought to sleeve over said tapered end, to cooperate with said abutment shoulder to clamp said face plate therebetween so as to secure a respective one of said spray nipples to said face plate.

2. The showerhead as claimed in claim 1, wherein said nozzle bodies are made of rubber.

3. The showerhead as claimed in claim 1, wherein said nozzle body of each of said spray nipples further includes an engaging flange which is formed on said abutment shoulder and which is inserted in said through hole and in friction contact with said respective one of said inner peripheral walls.

4. The showerhead as claimed in claim 3, wherein said securing sleeve member of each of said spray nipples further includes an engaging ring formed on and extending rearwardly of said rear abutting end portion so as to abut against said engaging flange in said through hole after said securing sleeve member has been sleeved on said shank end.

* * * * *